US005154423A

United States Patent [19]

Antonious

[11] Patent Number: 5,154,423

[45] Date of Patent: Oct. 13, 1992

[54] IRON TYPE GOLF CLUB HEAD HAVING A SINGLE SOLE RUNNER

[76] Inventor: Anthony J. Antonious, 7738 Calle Facil, Sarasota, Fla. 34238

[21] Appl. No.: 761,481

[22] Filed: Sep. 18, 1991

[51] Int. Cl.[5] ..... A63B 53/04

[52] U.S. Cl. ..... 273/167 A; 273/172; 273/174

[58] Field of Search ..... 273/167-175, 273/164, 77 R, 77 A, 193 R-194 B, 183 D; D21/214-220

[56] References Cited

U.S. PATENT DOCUMENTS

| | | | |
|---|---|---|---|
| D. 130,590 | 12/1941 | McWhirter | 273/167 D |
| 645,944 | 3/1900 | Dalgleish | 273/174 X |
| 1,436,579 | 11/1922 | Dayton | 273/172 X |
| 1,531,821 | 3/1925 | Scott | 273/164 |
| 1,669,482 | 5/1928 | Miller | 273/174 |
| 1,913,821 | 6/1933 | Stumpf | 273/174 X |
| 2,004,968 | 6/1935 | Young | 273/174 |
| 2,708,579 | 5/1955 | Hugman | 273/174 X |
| 3,068,011 | 12/1962 | Sana | 273/174 |
| 3,761,095 | 9/1973 | Thompson | 273/174 |
| 3,815,921 | 6/1974 | Turner | 273/174 |
| 3,992,013 | 11/1976 | Golden | 273/171 X |
| 4,332,388 | 6/1982 | Crow | 273/172 |
| 4,498,673 | 2/1985 | Swanson | 273/172 |
| 4,671,513 | 6/1987 | Swanson | 273/172 |
| 4,804,184 | 2/1989 | Maltby | 273/172 X |
| 4,832,344 | 5/1989 | Werner | 273/172 X |
| 4,838,555 | 6/1989 | Kobayashi | 273/167 A |

FOREIGN PATENT DOCUMENTS

| | | | |
|---|---|---|---|
| 364845 | 1/1932 | United Kingdom | 273/174 |

*Primary Examiner*—William H. Grieb
*Assistant Examiner*—Sebastiano Passaniti
*Attorney, Agent, or Firm*—Nicholas J. Aquilino

[57] ABSTRACT

An iron type golf club head having a single runner centrally located on the bottom sole in a heel-to-toe direction under the center of gravity. The runner extends outwardly from the sole and is progressively thicker in a direction from the leading edge to the rear edge for engaging the ground surface prior to the bottom sole when a golf club is used during the execution of a golf shot.

11 Claims, 5 Drawing Sheets

FIG. 1
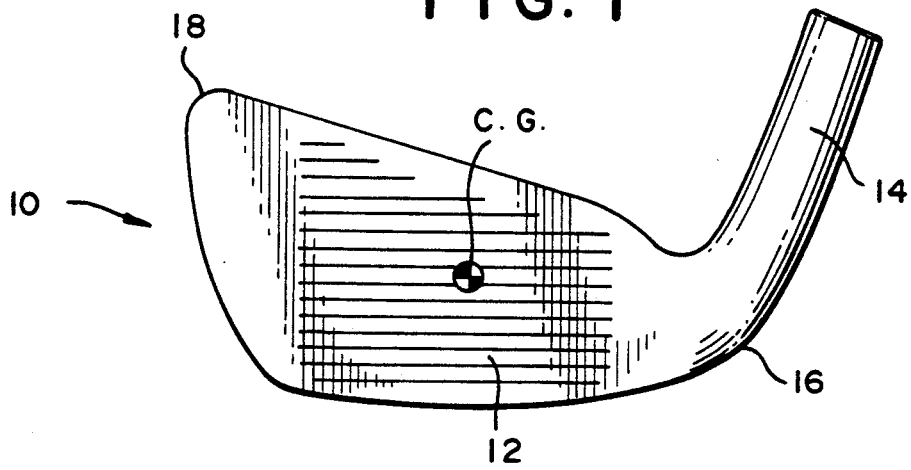
FIG. 2
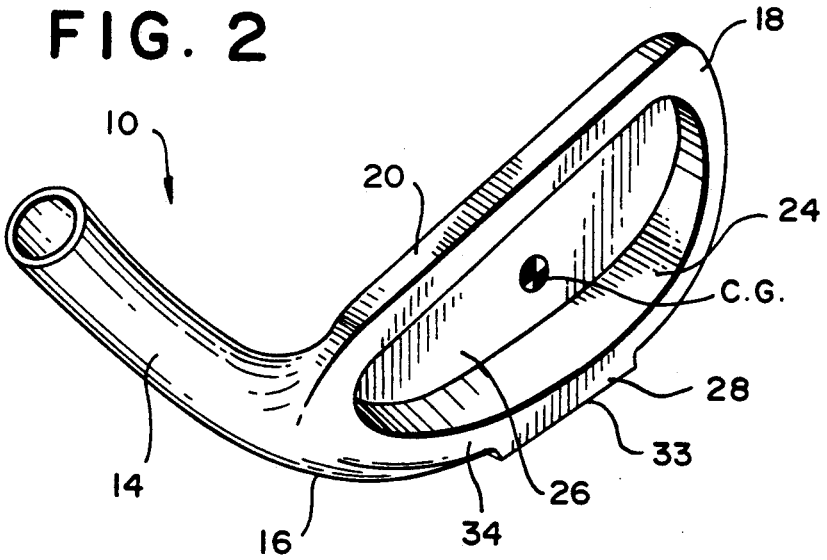
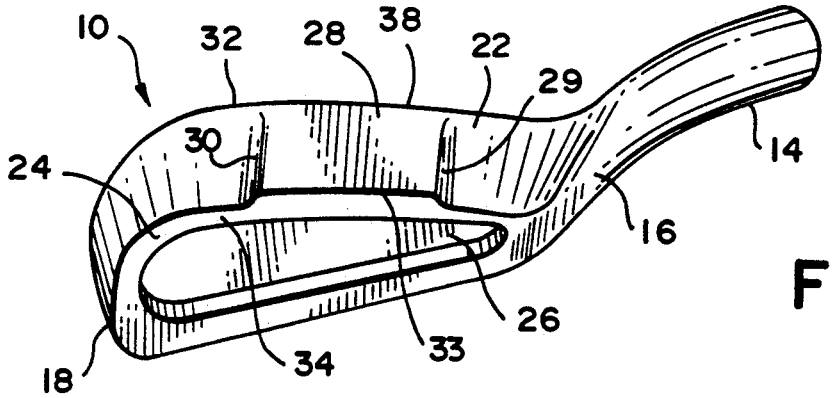
FIG. 3

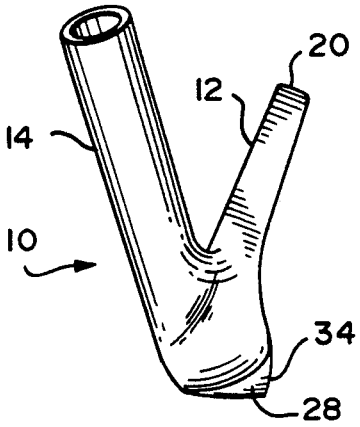
FIG. 4
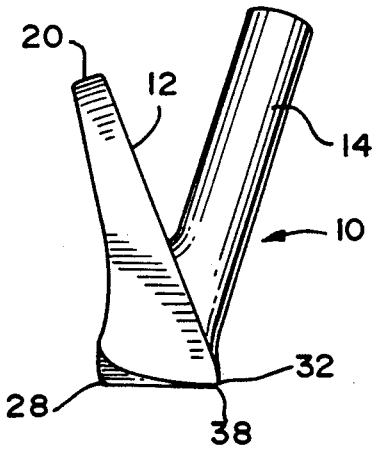
FIG. 5
FIG. 6
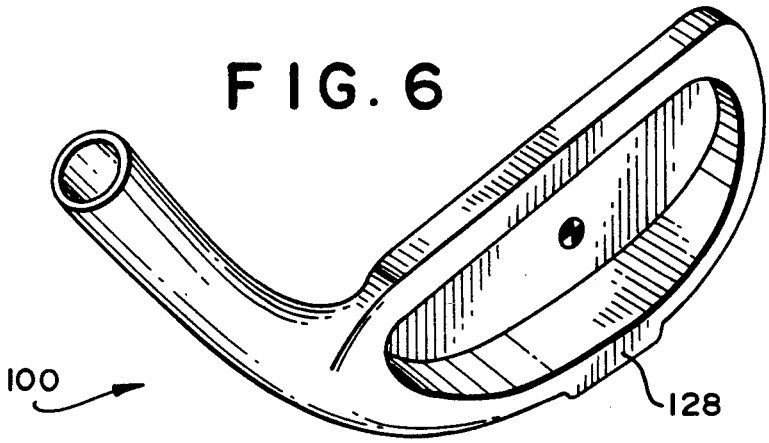
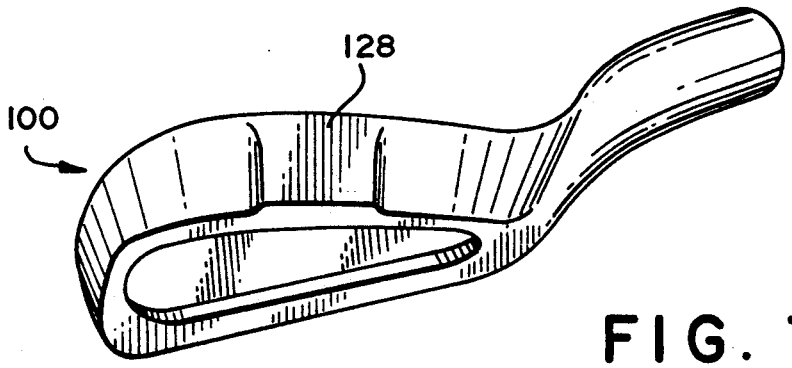
FIG. 7

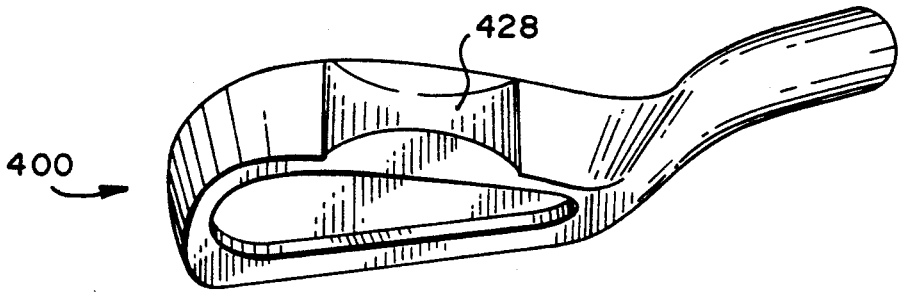
FIG. 11
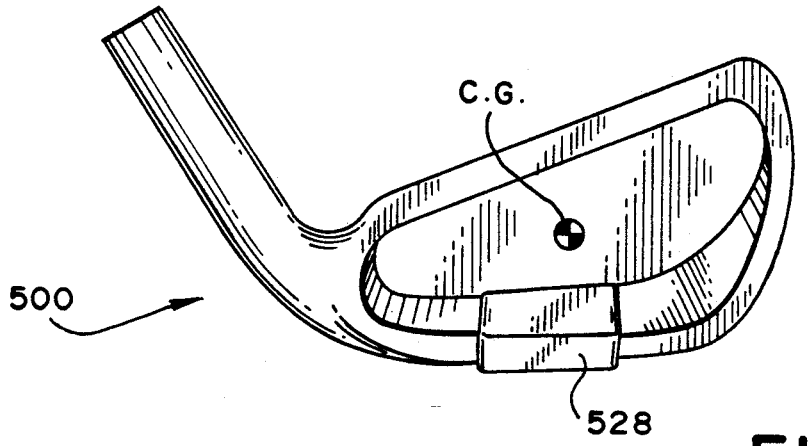
FIG. 12
FIG. 13
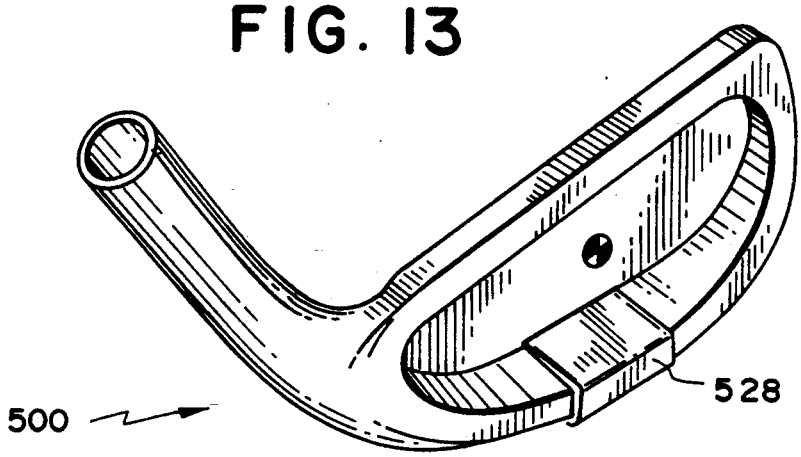

IRON TYPE GOLF CLUB HEAD HAVING A SINGLE SOLE RUNNER

BACKGROUND AND DESCRIPTION OF THE INVENTION

The present invention relates to an iron type golf club head, and in particular, to an iron type golf club head having a single skid member formed on the sole. With conventional golf club heads, a substantial portion of the club sole engages the ground surface during the execution of a shot, causing the club head to decelerate considerably and to torque, or turn because of the resistance encountered. This is particularly true when a ball is lying in a less than ideal position, such as a divot depression, rough, heavy grass, hard or rocky ground, a sandtrap or other naturally occurring areas other than a closely cut fairway.

Prior art golf clubs which use sole configurations to lessen contact with the sole with the ground surface include those to Scott (U.S. Pat. No. 1,531,821), Stumpf (U.S. Pat. No. 1,913,821), Golden (U.S. Pat. No. 3,992,013), Sano (U.S. Pat. No. 3,068,011), Gordos (U.S. Pat. No. 4,065,133), and Crow (U.S. Pat. No. 4,332,388). All of these are not iron type golf clubs, they are wood type golf clubs which have relatively flat sole surfaces to which a plurality of runners or shaped individual runners are added to the club head. The structures also raise the entire club head, including the leading edge of the club head above the ground surface, which requires that the club be swung in a sweeping fashion in order to eliminate the bounce which would be encountered when the runners initially hit the ground. Although this arrangement works with wood type golf club heads, it is a disadvantage for iron type golf club heads, which, for best results, require the leading edge to penetrate the ground surface during the execution of a shot. Having the leading edge of the iron club raised would not allow the club head to easily get below the ball in order for it to make proper contact on the ball striking face adjacent the center of percussion. The resulting bounce will cause the club head to strike the ball nearer the bottom of the club head, resulting in an undesirable bladed, or skulled shot, which a golfer cannot control.

SUMMARY OF THE INVENTION

The present invention relates to an iron type golf club head using a single skid member on the sole of the club wherein the member tapers between the rear edge of the club head and the leading edge at a gradually increasing angle so that the sole of the club head, regardless of its contour, is raised above the ground surface at an angle from the front to the rear of the club. The skid member is positioned between the toe and the heel, preferably below the center of gravity or center of percussion on the ball striking face, and extends in a front-to-rear direction. Alternately, the skid member may be positioned eccentrically from the center of gravity (C.G.) such as predominantly between the center of gravity (C.G.) and the toe or heel portion of the club head sole. The skid member starts precisely at or adjacent to the leading edge of the club head so that the leading edge is raised no more than conventional irons above the ground surface at address or when properly contacting the ball. As the skid member tapers rearwardly, the sole of the club head is gradually raised so that as the sole contacts the ground surface, at least the rearward portion of the sole on each side of the skid member is raised above the ground, preventing excessive digging into the ground surface, yet permitting the ball striking face to be low enough to ensure proper contact with the ball on the center of percussion. This arrangement eliminates undesirable bounce and minimizes lateral club head movement, particularly if the shot is being played from a divot, or hard ground surface, so that the club head maintains its position relative to the ball without bouncing or excessively penetrating the ground.

The skid member may be formed in a variety of shapes having planar surfaces to lessen club head resistance from the ground when contact with the ground is made. Preferred embodiment uses a single, rectangular runner configuration extending in the heel-to-toe direction, and in the front-to-rear direction. A variety of widths are contemplated, as well as a number of various shapes, as described in greater detail in the present application. Using the club head with a single skid member on a normal grass surface such as a fairway, the skid member prevents the club head from penetrating too deeply into the turf, thereby keeping the face much cleaner so that grass and dirt will not affect the ball as it is being struck, and also preventing undue resistance which would reduce the club head speed and cause it to torque during the execution of a swing. In deep grass, the skid member keeps most of the sole surface of the club head above the ground surface so that the full width of the leading edge of the ball striking face does not penetrate deeply into the grass, thereby stabilizing the club head at impact and preventing it from twisting and decelerating due to the increased resistance. On hard ground, only the skid member initially slides across the ground surface, preventing the leading edge of the club from either bouncing or digging too deeply into the ground, minimizing lateral movement, thereby creating a more consistent ground contact result which retains the proper loft angle of the club face relative to the ball to produce more consistent and accurate shots. Among the objects of the present invention are: to provide a new and improved iron type golf club head having a sole with a single skid member which lessens the ground surface area that the club head contacts and minimizes the effect of ground resistance during the execution of a shot; to provide a golf club head which reduces the effect of ground resistance as a ball is being struck; and to provide an iron type golf club head which maintains the proper club face loft angle when the ground is encountered during the execution of a golf shot.

Other objects and advantages will become apparent from the following description and drawings.

DESCRIPTION OF THE DRAWINGS

FIG. 1 shows a front elevational view of a golf club head in accordance with the present invention.

FIG. 2 is a rear perspective view of the club head of FIG. –

FIG. 3 is a bottom view of the club head of FIG. 1.

FIG. 4 is an end elevational view of the club head of FIG. 1.

FIG. 5 is an end elevational view taken from the opposite side of FIG. 4.

FIG. 6 is a rear perspective view of a second embodiment of a golf club head of the present invention.

FIG. 7 is a bottom view of the club head of FIG. 6.

FIG. 11 is a bottom view of the club head of FIG. 10.

FIG. 12 is a rear elevational view of a sixth embodiment of the present invention.

FIG. 13 is a rear perspective view of the club head of FIG. 12.

DESCRIPTION OF PREFERRED EMBODIMENTS

Figure 8:
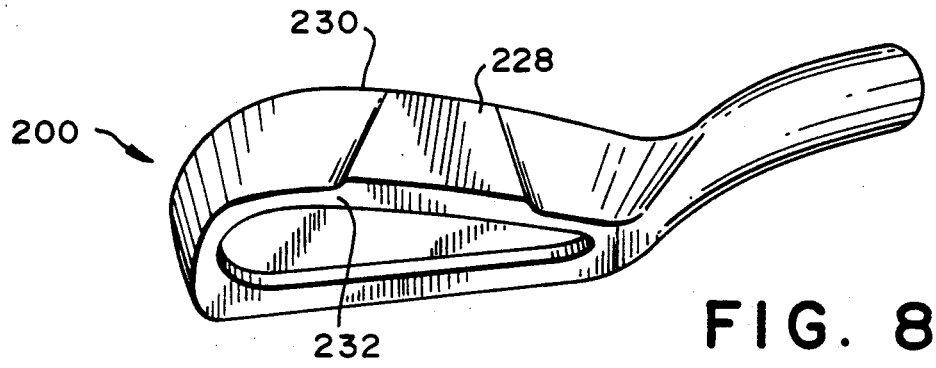
FIG. 8 is a bottom view of a third embodiment of the present invention.

FIGS. 1 through 5 show a first embodiment of a golf club head 10 in accordance with the present invention, including a ball striking face 12, a hosel 14, a heel 16, a toe 18, top ridge 20 and bottom sole 22 having a planar surface defining the lower portion of the club head 10 In a preferred embodiment, the club head 10 is peripheral weighted has a left angle of at least 12 degrees and include a peripheral mass 24 defining a cavity 26. However, it will be appreciated that the invention is equally applicable to planar or muscle back type golf club heads. A center of gravity (C.G.), defined as the optimum position on which to strike a golf ball to transfer maximum energy to the ball is shown positioned approximately in the center of the club head.

The present invention resides in the use of a single sole runner 28 located on and positioned outwardly from the bottom sole 22. Preferably, the runner 28 is centrally located with respect to the center of gravity (C.G.). As shown in the drawings, the runner 28 is generally rectangular in shape and includes sides 29 and 30 which, in this embodiment, are parallel to each other in the front-to-rear direction of the club head 10. A front edge 38 of the runner 28 is coincident with the leading edge 32 of the club head. A rear edge 33 of the runner 28 is raised above the bottom sole 22 and is generally coincident with the rear surface 34 of the club head, whereby the runner 28 extends from the leading edge 33 of the ball striking face rearwardly to the rear surface 34 of the club head. Preferably, the thickness of the runner 28 is progressively larger in the front-to-rear direction, so that the ground contacting surface 34 of the runner 28 is further from the bottom sole at the rear edge than it is further toward the leading edge of the club head where, at the leading edge, it is substantially flush with the bottom sole. In this embodiment, the runner 28 is relatively wide and extends at least one-third and up to one-half of the total distance of the bottom sole in the heel-to-toe direction.

When striking a golf ball, particularly out of a bad lie, the single runner contacts the ground surface before the sole, thus enabling the club to be swung at a relatively sharp angle to ensure maximum contact with the ball while minimizing the negative effects that would occur if the club head digs into the ground surface. The runner enables the club head to ride along the ground surface without digging into the surface, ensuring that optimum contact is made with the ball, thereby ensuring maximum energy transfer. Both heel and toe portions of the club head 10 are raised above the ground surface by the runner 28 to further minimize the digging in, or snagging, of the club head during a swing.

It will be appreciated that the thickness of the runner 28 may be varied in accordance with the loft of a particular golf club. For example, with the high-lofted irons, such as the wedges and nine iron, where it is more likely that a golf ball will be struck with a descending blow, it is contemplated that the runner would have a greater thickness than runners used on low-lofted irons, such as one, two or three irons for example, where the ball is generally struck with a more sweeping swing path.

FIGS. 6 and 7 show a second embodiment of a golf club head 100 of the present invention which is the same as the club described hereinabove, with the exception that the runner 128 is narrower in the heel-to-toe direction. In this embodiment, the runner 128 extends approximately one-quarter to one-third of the distance in the heel-to-toe direction.

FIG. 8 shows a third embodiment of a golf club head 200 of the present invention in which the runner 228 is trapezoidal in shape and is narrower at the leading edge 230 and is progressively wider toward the rear edge of 232 of the club head 200.

Figure 9:
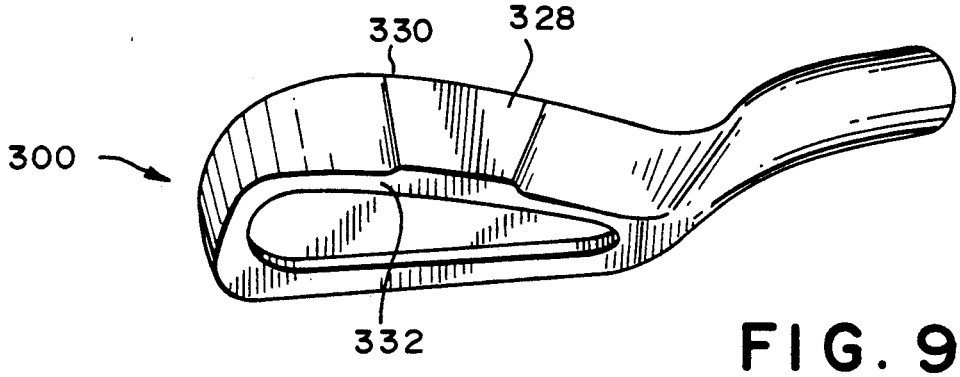
FIG. 9 is a bottom view of a fourth embodiment of the present invention.

FIG. 9 shows a fourth embodiment of a club head 300 of the present invention, wherein the runner 328 is wider at the leading edge 330 and becomes progressively narrower toward the rear edge 332.

Figure 10:
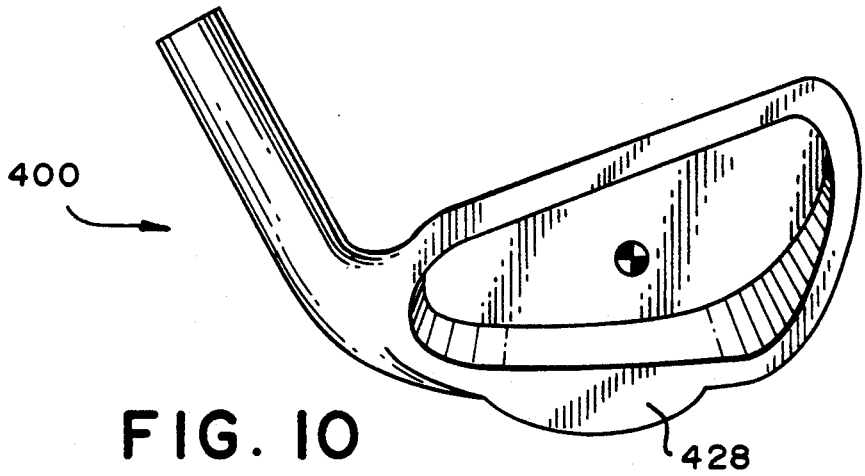
FIG. 10 is a rear elevational view of a fifth embodiment of the present invention.

FIGS. 10 and 11 show a fifth embodiment of a club head 400 of the present invention wherein the sole runner 428 is pontoon-shaped, and extends outwardly from the bottom sole in an arcuate configuration in a heel-to-toe direction.

FIGS. 12 and 13 show a sixth embodiment of a golf club head 500 of the present invention in which the runner 528 extends upwardly and rearwardly into a rear cavity of the club head. This arrangement provides additional mass directly under the center of gravity (C.G.) so that the overall weight of the club head may be controlled with the size of the runner.

Figure 14:
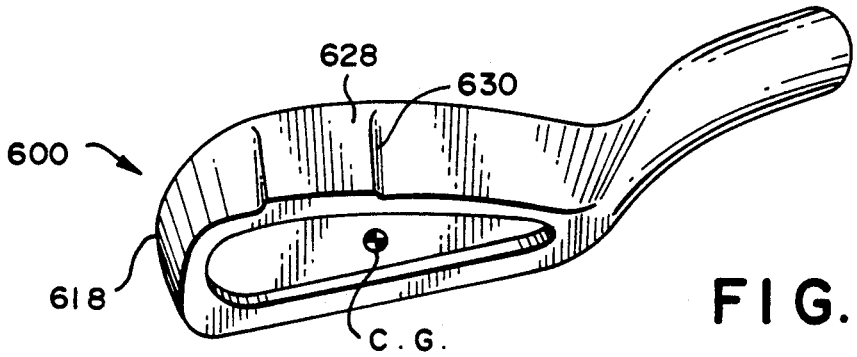
FIG. 14 is a bottom view of a seventh embodiment of the present invention.
Figure 15:
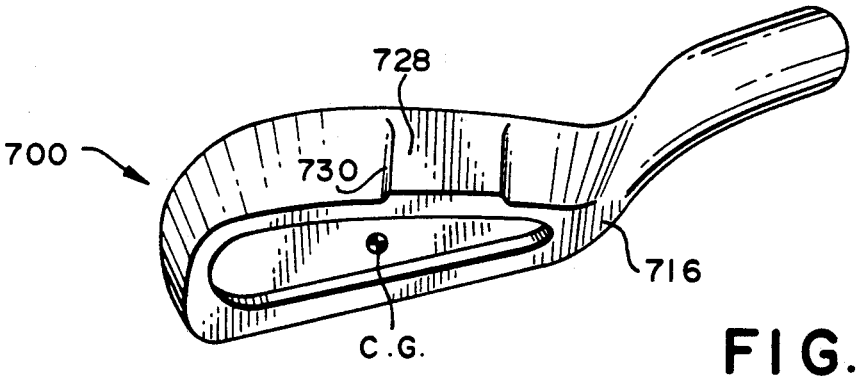
FIG. 15 is a bottom view of an eighth embodiment of the present invention.
Figure 16:
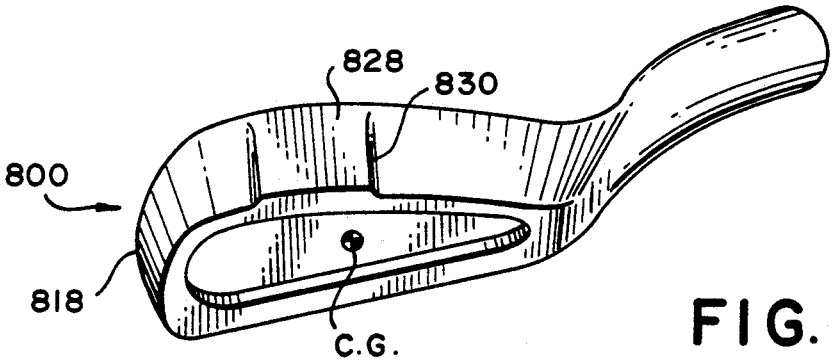
FIG. 16 is a bottom view of a ninth embodiment of the present invention.
Figure 17:
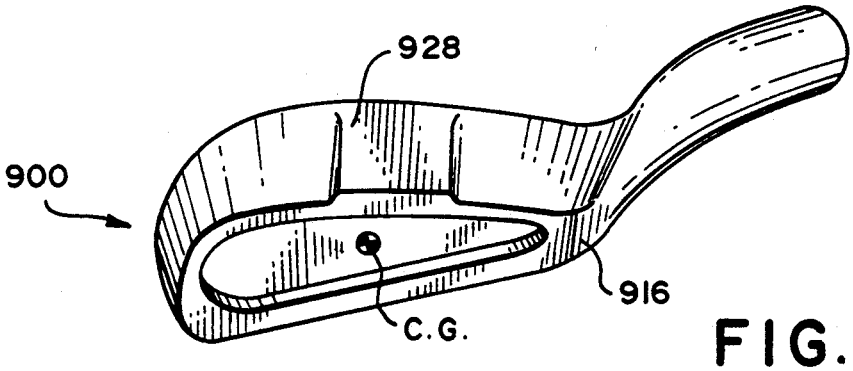
FIG. 17 is a bottom view of a tenth embodiment of the present invention.

FIGS. 14, 15, 16 and 17 show four additional embodiments of the present invention, in which the sole runner is eccentrically located with respect to the center of gravity. FIG. 14 shows a seventh embodiment of a golf club head 600 having the runner 628 eccentrically located between the toe 618 and the center of gravity (C.G.) on the club head 600 where an edge 630 of the runner 628 is essentially in line with the center of gravity (C.G.). FIG. 15 shows an eighth embodiment of a golf club head 700, wherein a runner 728 is located between the center of gravity (C.G.) and the heel 716, and an edge 730 of the runner 728 is in line with the center of gravity (C.G.). FIG. 16 shows a ninth embodiment of a golf club head 800 of the present invention, in which the runner 828 is eccentrically located toward the toe 818, having an edge 830 slightly offset from the center of gravity (C.G.). FIG. 17 shows a tenth embodiment of a golf club head 900 of the present invention in which a runner 928 is located toward the heel 916 of the club head and has an edge 930 positioned slightly offset from the center of gravity (C.G.).

It will be appreciated that other embodiments of the club head may be provided in keeping within the spirit and scope of the present invention, as defined in the following claims:

I claim:

1. An iron type golf club head including a hosel, a heel, a toe, a ball striking face, a rear surface, a bottom sole having a planar surface, a leading edge formed at an interface of the ball striking face and the bottom sole, a rear edge formed at an interface of the bottom sole and the rear surface, said club head including a center of gravity located proximate the midpoint of said ball striking face, wherein the improvement comprises:

means for engaging a ground surface prior to the bottom sole engaging the ground surface when the golf club head is swung during the execution of a golf shot;

said ground surface engaging means including a single runner located on said bottom sole and extending outwardly from the planar surface of said bottom sole;

said runner extending from the leading edge to the rear edge of the golf club head, said runner having a planar upper surface and being rectangular in shape and having a first pair of peripheral edges parallel to the leading edge and rear edge of the club head, respectively, and a second pair of peripheral edges perpendicular to the leading edge and the rear edge;

said first peripheral edges having a greater length than said second peripheral edges; and said runner including sides progressively thicker in a direction from the leading edge to the rear edge of the club head, thereby raising the upper surface of the runner progressively higher from the planar surface of the bottom sole toward the rear surface.

2. The golf club head of claim 1 wherein said runner extends at least one-third and up to one-half of the distance along said bottom sole in a heel-to-toe direction.

3. The golf club head of claim 1 wherein said runner extends at least one-quarter and up to one-third of the distance along said bottom sole in the heal-to-toe direction.

4. The golf club head of claim 1 wherein the runner is centrally located with respect to a plane perpendicular to the bottom sole and passing through the center of gravity.

5. The golf club head of claim 1 wherein the runner is eccentrically located with respect to a plane perpendicular to the bottom sole and passing through the center of gravity.

6. The golf club head of claim 1 wherein one of said second peripheral edges is in line with a plane perpendicular to the bottom sole and passing through the center of gravity.

7. The golf club head of claim 5 wherein the runner is eccentrically located toward the toe of the club head.

8. The golf club head of claim 1 wherein the runner is eccentrically located toward the heel of the club head.

9. An iron type golf club head having a loft angle of at least 12 degrees, including a hosel, a heel, a toe, a ball striking face, a rear surface, a bottom sole having a planar surface, a leading edge formed at an interface of the ball striking face and the bottom sole and having a center of gravity wherein the improvement comprises:

means for engaging a ground surface prior to the bottom sole engaging the surface when the golf club head is swung during the execution of a golf shot; and said ground surface engaging means including a single runner located on said bottom sole and extending outwardly from the planar surface of said bottom sole; said runner extending from the leading edge to the rear surface of the golf club head, said runner having a planar upper surface and being trapezoidal shaped and having first peripheral edges parallel to the leading edge and rear surface, and second peripheral edges being angularly oriented to the leading edge and rear surface, at least one of said first peripheral edges having a greater length than said second peripheral edges;

said runner including sides progressively thicker in a direction from the leading edge to the rear edge of the club head, thereby raising the upper surface of the runner progressively higher from the planar surface of the bottom sole toward the rear surface.

10. The golf club head of claim 9 wherein the trapezoid shape includes a small base and a large base, the large base interfacing with the leading edge of the club head.

11. The golf club head of claim 10 wherein the large base interfaces with the rear surface of the club head.

* * * * *